US009834372B2

(12) United States Patent
Mariller

(10) Patent No.: US 9,834,372 B2
(45) Date of Patent: Dec. 5, 2017

(54) CAPSULE WITH A RUPTURABLE MEMBRANE USED IN PREPARING A DRINK

(75) Inventor: Alain Mariller, Le Mont-Pèlerin (CH)

(73) Assignee: ETHICAL COFFEE COMPANY SA, Fribourg (CH)

( * ) Notice: Subject to any disclaimer, the term of this patent is extended or adjusted under 35 U.S.C. 154(b) by 903 days.

(21) Appl. No.: 13/144,191

(22) PCT Filed: Jan. 7, 2010

(86) PCT No.: PCT/IB2010/050051

§ 371 (c)(1),
(2), (4) Date: Aug. 5, 2011

(87) PCT Pub. No.: WO2010/079454

PCT Pub. Date: Jul. 15, 2010

(65) Prior Publication Data

US 2011/0283891 A1 Nov. 24, 2011

(30) Foreign Application Priority Data

Jan. 12, 2009 (WO) ..... PCT/IB2009/050111
Sep. 12, 2009 (WO) ..... PCT/IB2009/053995

(51) Int. Cl.
*B65D 85/804* (2006.01)
*A47J 31/40* (2006.01)
*B65D 65/46* (2006.01)

(52) U.S. Cl.
CPC ..... *B65D 85/8043* (2013.01); *B65D 65/466* (2013.01)

(58) Field of Classification Search
CPC ..... B65D 85/8043; B65D 65/466
USPC ..... 99/295, 279, 298, 321, 323, 302 R; 206/219, 222; 426/115, 77, 78, 79
See application file for complete search history.

(56) References Cited

U.S. PATENT DOCUMENTS 1,687,095 A * 10/1928 Jones ..... 426/433
5,947,004 A * 9/1999 Huang ..... 99/299
5,948,455 A * 9/1999 Schaeffer et al. ..... 426/77
(Continued)

FOREIGN PATENT DOCUMENTS

DE 2 063 398 7/1971
DE 20 63 398 7/1971
(Continued)

OTHER PUBLICATIONS

International Search Report for PCT/IB2010/050051, dated May 7, 2010.
(Continued)

*Primary Examiner* — Quang D Thanh
*Assistant Examiner* — James Sims, III
(74) *Attorney, Agent, or Firm* — Nixon & Vanderhye P.C.

(57) ABSTRACT

The present invention relates to a capsule for preparing a drink, for example coffee, including a hollow element (1) for containing a metered amount (2) of e.g. ground coffee, said hollow element including a side wall, an upper surface, and a lower surface with at least one membrane (4), said membrane being rupturable under the pressure of a liquid placed into the capsule to enable the flow of liquid through the metered amount, said capsule also including a cover (5) with at least one hole, said hole enabling the membrane (4) to rupture.

32 Claims, 7 Drawing Sheets

(56) References Cited

U.S. PATENT DOCUMENTS

| | | | | |
|---|---|---|---|---|
| 6,740,345 | B2 * | 5/2004 | Cai | 426/77 |
| 7,412,921 | B2 * | 8/2008 | Hu | A47J 31/0668 426/77 |
| 8,161,868 | B2 * | 4/2012 | Bolzicco et al. | 99/295 |
| 2002/0078831 | A1 | 6/2002 | Cai | |
| 2005/0172822 | A1 * | 8/2005 | Macchi et al. | 99/295 |
| 2010/0303965 | A1 * | 12/2010 | Mariller | A47J 31/3628 426/84 |

FOREIGN PATENT DOCUMENTS

| | | |
|---|---|---|
| DE | 20 2008 00266 | 5/2008 |
| EP | 0 554 469 | 8/1993 |
| EP | 1 595 817 | 11/2005 |

OTHER PUBLICATIONS

Foreign-language Written Opinion of the International Searching Authority for PCT/IB2010/050051, dated May 7, 2010.
Notice of Reason(s) for Rejection, JP Appln. No. 2011-544958, Dec. 8, 2015.

* cited by examiner

CAPSULE WITH A RUPTURABLE MEMBRANE USED IN PREPARING A DRINK

This application is the U.S. national phase of International Application No. PCT/IB2010/050051, filed 7 Jan. 2010, which designated the U.S., and claims priority to IB Application No. PCT/IB2009/050111, filed 12 Jan. 2009; and IB Application No. PCT/IB2009/053995, filed 12 Sep. 2009, the entire contents of each of which are hereby incorporated by reference.

FIELD OF THE INVENTION

The present invention is situated in the field of preparation of drinks, for example coffee-based drinks, by extraction of a concentrated dose, for example of ground coffee, contained in a capsule. It relates more particularly to the doses used for this purpose and to the devices using such doses and to the methods applied during the use of such doses.

DESCRIPTION OF THE PRIOR ART

Capsules and machines operating according to the aforementioned principle have existed for many decades.

U.S. Pat. No. 2,899,886, U.S. Pat. No. 2,968,560, U.S. Pat. No. 3,403,617 and U.S. Pat. No. 3,607,297 describe devices in which the capsule is initially perforated in several locations then passed through by pressurized water.

Other capsules furnished with a membrane are described in the following patent documents: EP 0 468 079 A, EP 0 806 373 A, EP 0 554 469 A.

SUMMARY OF THE INVENTION

Figure 1:
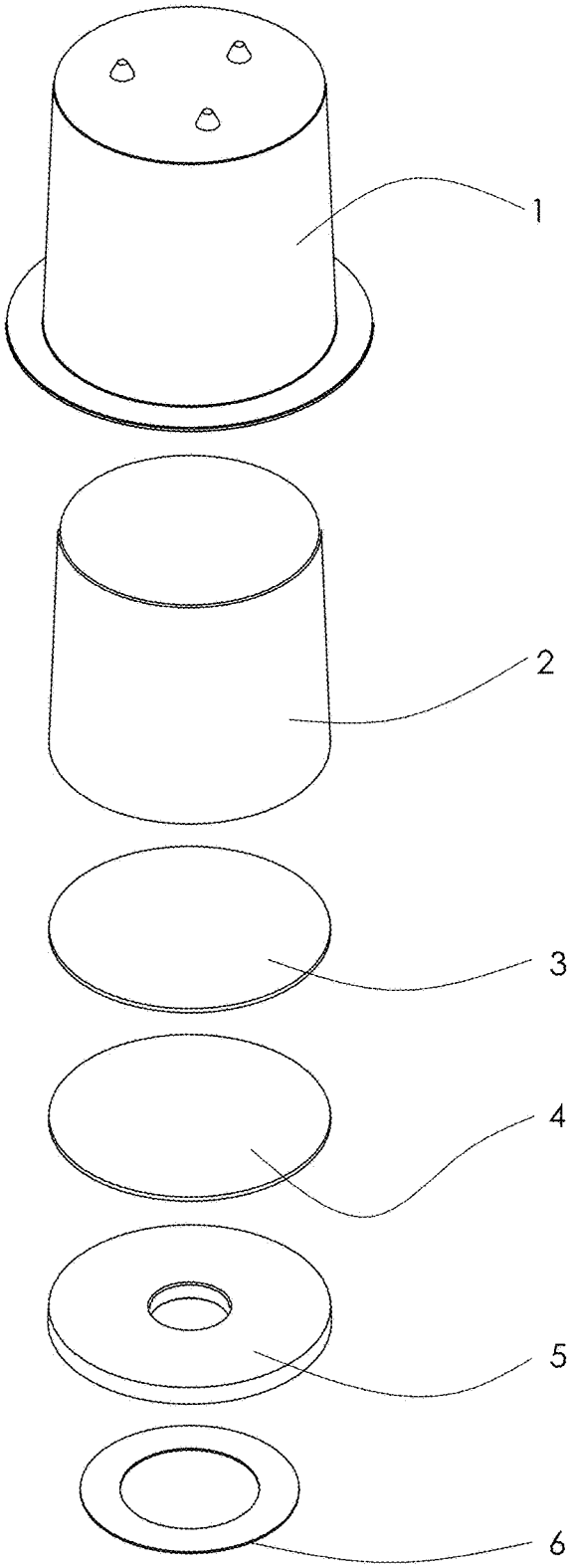
FIG. 1 is an exploded perspective view of capsule in accordance with an embodiment of the invention described herein.
Figure 2:
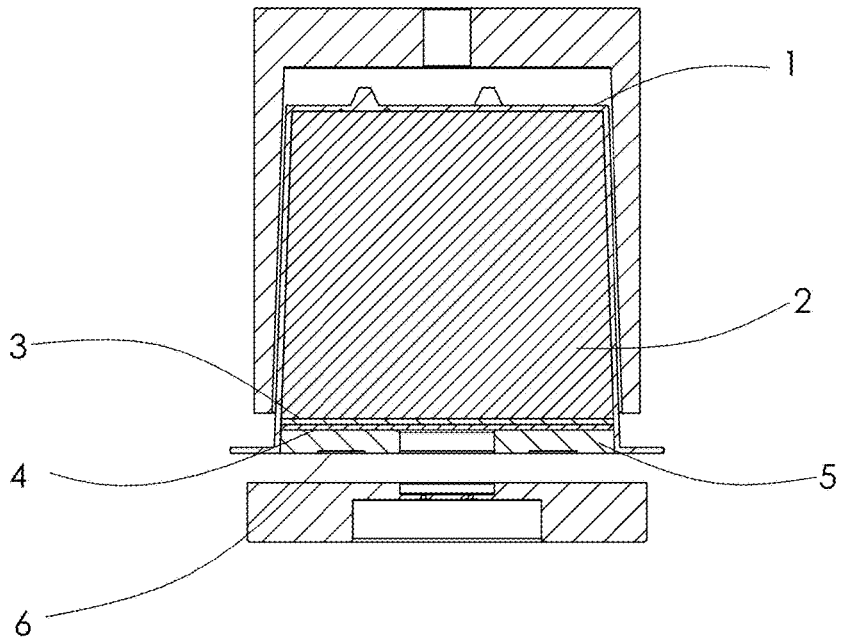
FIG. 2 is a cross-sectional view of the assembled capsule in opposed relationship to a base of an extraction device.
Figure 3:
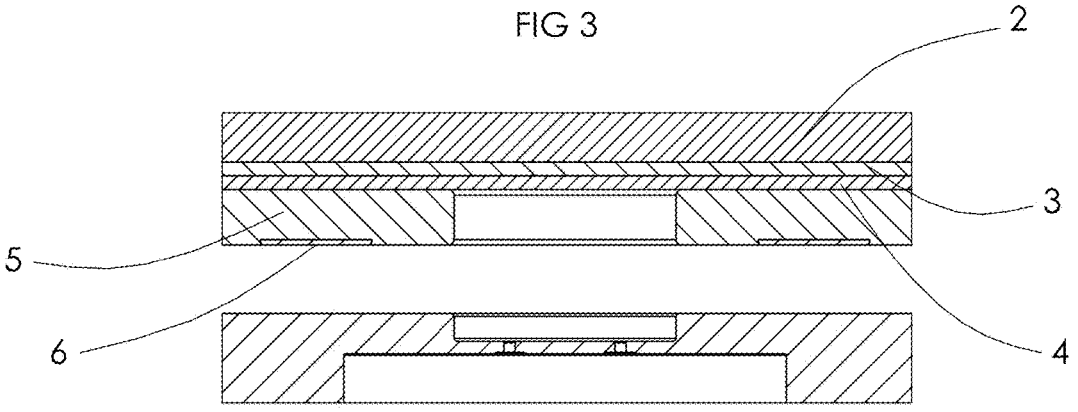
FIG. 3 is an enlarged cross-sectional view of the capsule and the opposed base as depicted in FIG. 2.
Figure 4:
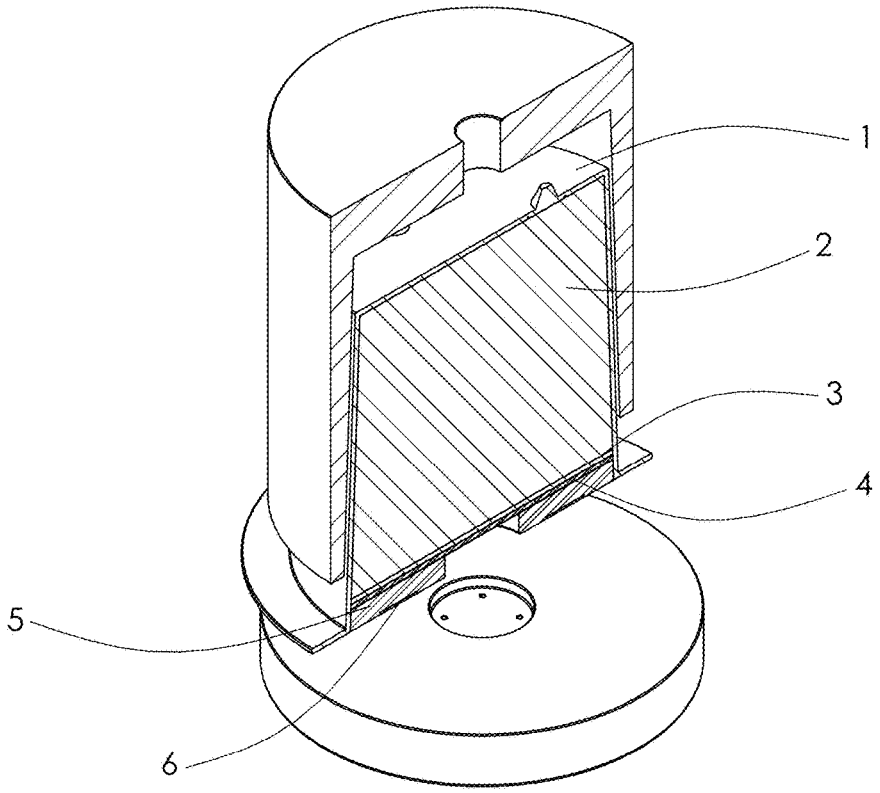
FIG. 4 is a perspective view, partly in cross-section, of the assembled capsule and the opposed base.
Figure 5:
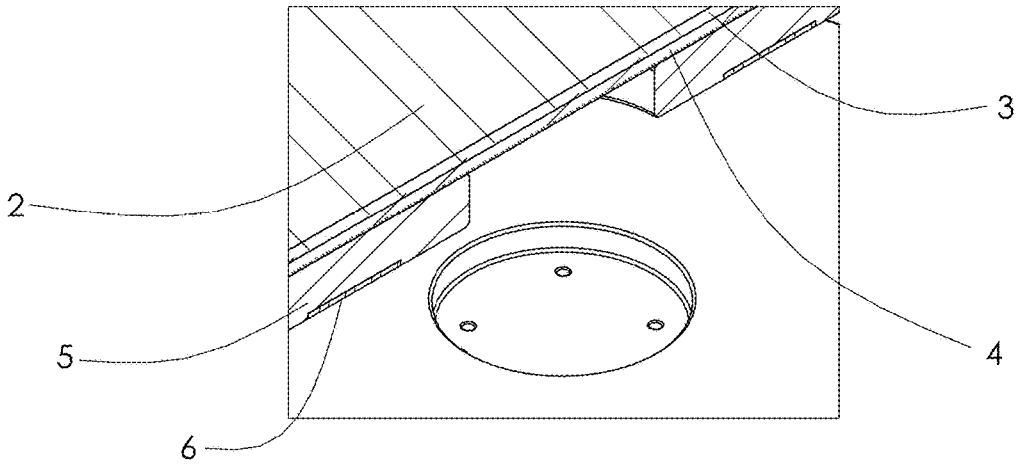
FIG. 5 is an enlarged detailed perspective view, partly in cross-section, of the assembled capsule and opposed base as depicted in FIG. 4.
Figure 6:
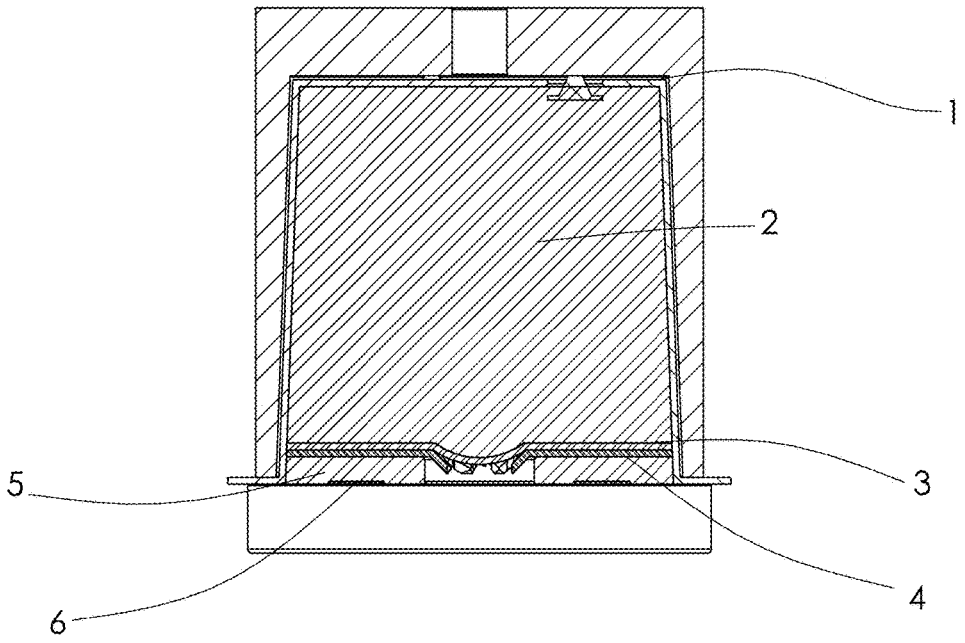
FIG. 6 is a cross-sectional elevational view of the capsule positioned within a capsule cage against the base of an extraction device showing the membrane being ruptured in the bursting zone thereof.
Figure 7:
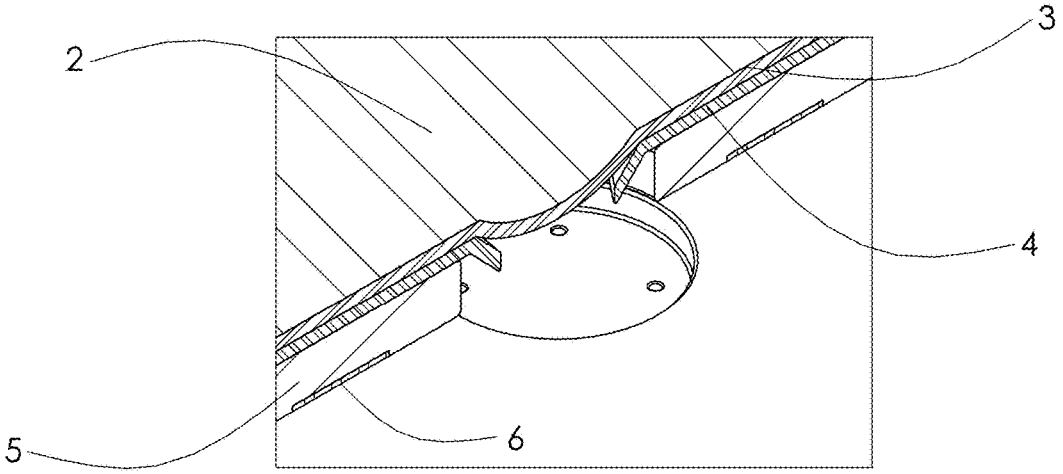
FIG. 7 is an enlarged detailed perspective view, partly in cross-section, similar to FIG. 5 but showing the membrane being ruptured in the bursting zone thereof.
Figure 8:
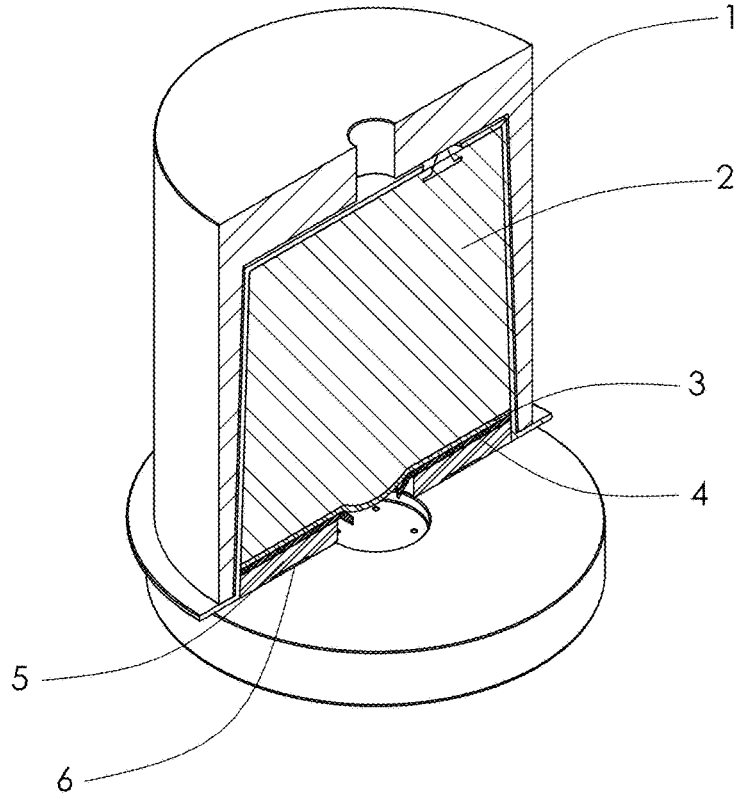
FIGS. 8 and 9 show the capsule and base similar to FIGS. 4 and 5 but showing the membrane being ruptured in the bursting zone thereof.
Figure 9:
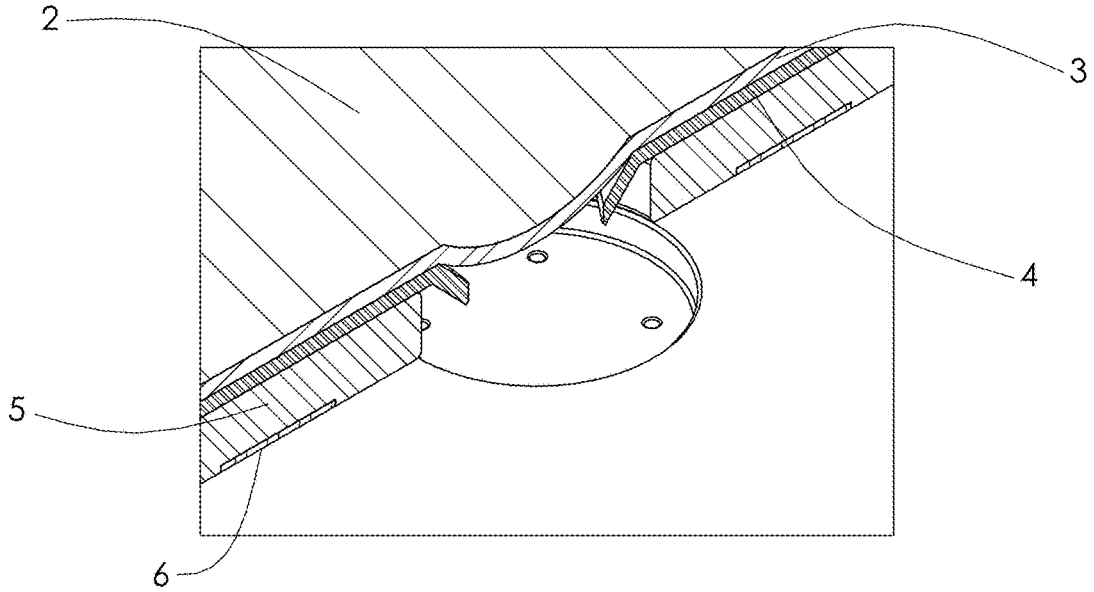

One of the objectives of the present invention lies in the creation of a capsule, preferably formed of biodegradable material, comprising a fusable membrane that bursts when its mechanical strength is exceeded. The bursting zone of the membrane is confined to one or more holes placed in a lid which covers the outer face of the membrane.

This objective is achieved with the capsule as defined in the claims.

According to the invention, the membrane that bursts is advantageously for example NATUREFLEX NE 30 or NM30 or any other material.

The various modes of execution of the invention are described with reference to the figures.

The latter illustrate the capsule according to the invention which comprises the following elements:

1: body of the capsule (in biodegradable or other material).
2: coffee (or other similar product)
3: knitted fabric (or woven fabrics or other filtering material such as paper etc.) in the form of a deformable membrane.
4: membrane (Natureflex with marter bi sealing resin or other product on top or underneath).
5: lid (in biodegradable or other material).
6: sheet of paper (or cardboard or other material).

Preferably, the extraction element of the capsule is formed in the following manner:

the knitted fabric 3 is placed on the membrane 4 which is sealed onto a solid element (5).

The operating principle is as follows:

the water enters the capsule by any method (needles, blades, self-piercing elements such as those illustrated on the top face of the body of the capsule);
the pressure rises in the capsule;
the extracted coffee is filtered through the knitted fabric 3;
the pressure will deform the membrane 4 at the hole(s) of the lid 5;
the lid having a sufficient thickness for the membrane to rest on the base in FIG. 3-5-7-9. This will exceed its mechanical strength and burst.
the pressurized coffee will therefore come out through the knitted fabric 3 and travel into the holes of the base illustrated in FIG. 3-5-7-9 underneath the capsule.

The thickness of the lid (5) may vary depending on the diameter of the hole in the latter and the thickness and the material of the bursting membrane.

The diameter of the hole(s) in the lid 5 may vary depending on many parameters (for example, in a nonlimiting manner): thickness and materials forming the knitted fabric 3 and/or the membrane 4 designed to burst, product 2 contained in the capsule. It is also possible to provide several holes in the lid. The holes may be in line with the inlets in the capsules, or be offset from the latter.

It is also possible to provide local weak spots in the membranes in order to make its bursting easier.

Figure 10:
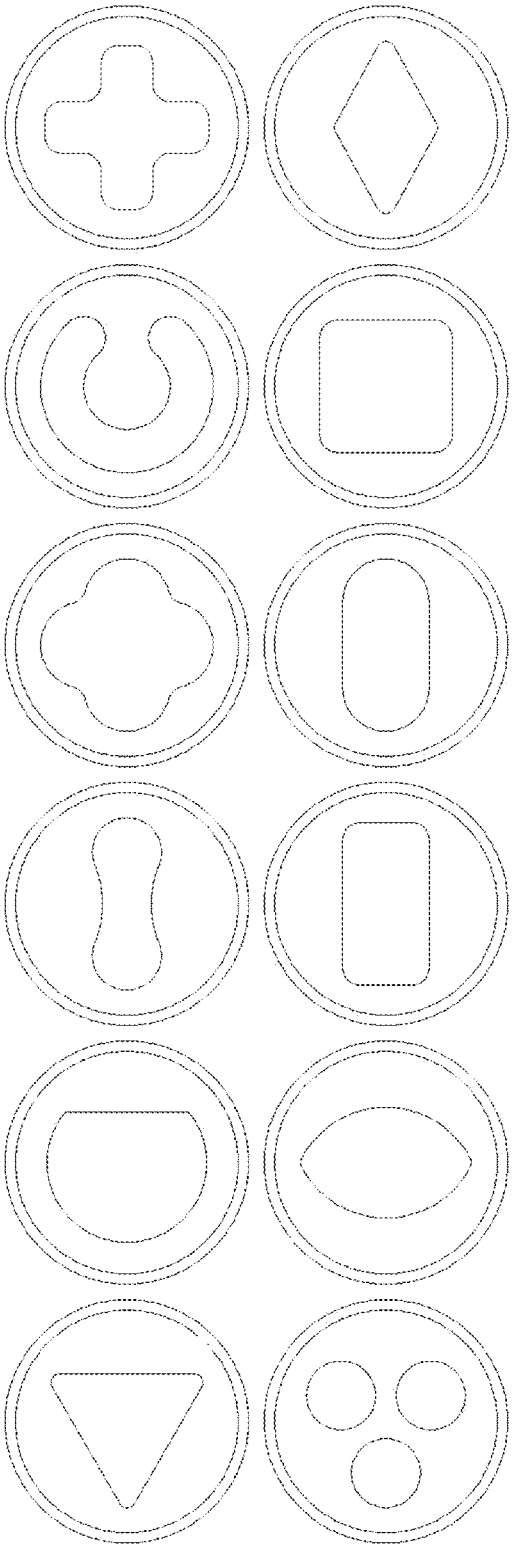
FIGS. 10 and 11 show alternative designs for the hole that may be employed in the lid of the capsule.
Figure 11:
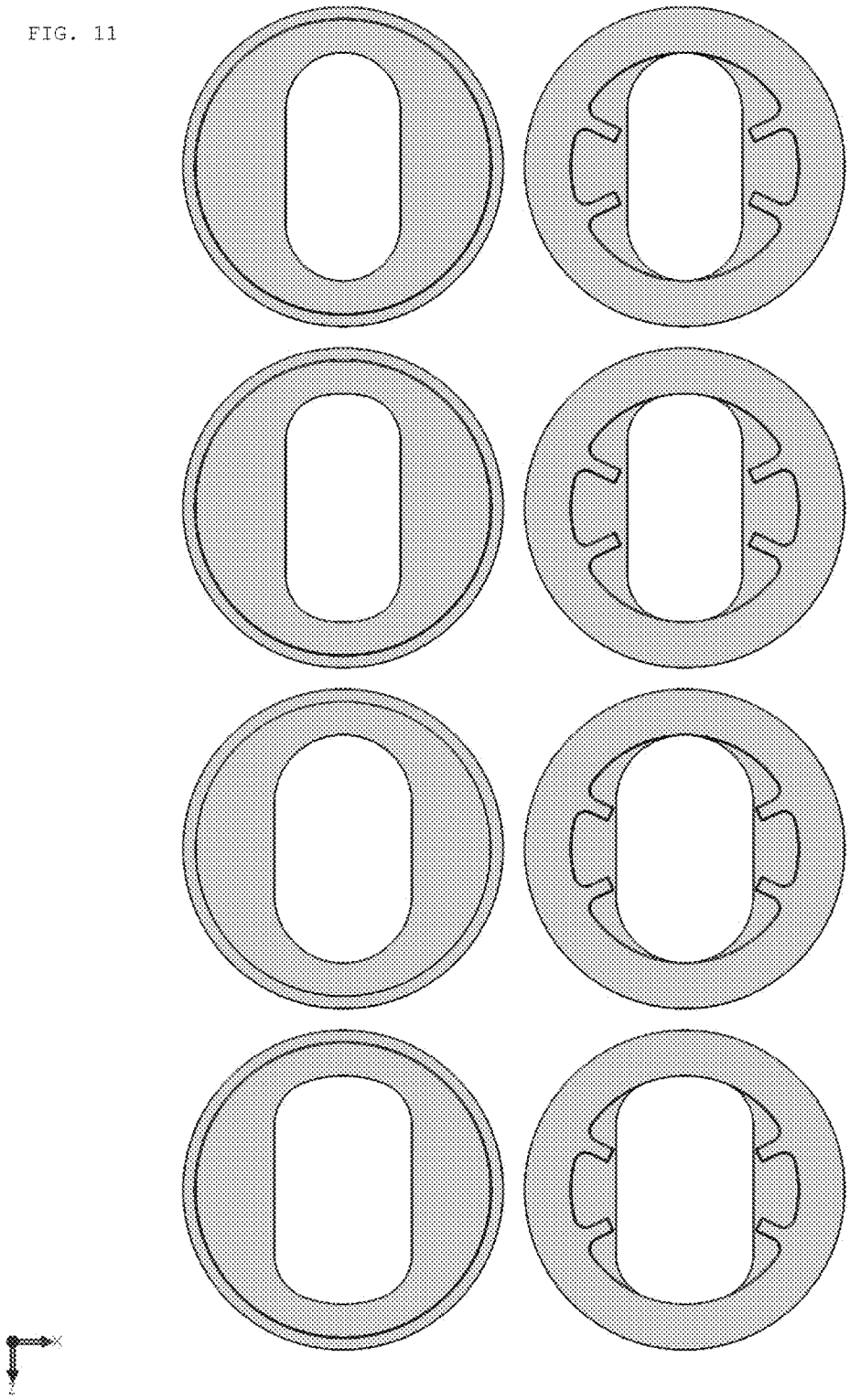

The shape of the holes, may also vary. FIGS. 10 and 11 illustrate various possibilities.

It should be noted that a noncircular shape has the advantage of the asymmetries in the way of causing the membrane to burst. Such asymmetries therefore make it possible to control the bursting better, both from the point of view of the bursting zone and of the moment at which the membrane bursts. The presence of asymmetries in the shape of the hole must frequently result in causing the membrane to burst more rapidly than in the case in which the cross section is of circular shape. In the latter case, the distribution of the tensions in the membrane is actually perfectly uniform.

The whole assembly is advantageously designed using materials that are for example biodegradable or partially biodegradeable. Naturally the modes of execution given above are given as nonlimiting examples and modifications are possible in the context of the present invention. Also, the various variants may be combined together.

The invention claimed is:

1. A capsule for the preparation of a coffee drink, said capsule comprising:

a hollow element designed to contain a dose of ground coffee, the hollow element comprising a side wall, a top face and a bottom face having a surface greater than the top face, at least one burstable membrane having an outer face, wherein the at least one burstable membrane is non-apertured prior to use of the capsule and bursts under pressure of a pressurized liquid introduced into the hollow element in order to allow the pressurized liquid to flow through the dose of ground coffee, and a lid which has a first face forming an external first surface of the capsule and a second face forming an internal second surface of the capsule, wherein the lid defines at least one outlet hole which extends between the internal second surface and the external first surface thereof for discharging the drink prepared in the hollow element, wherein the at least one burstable membrane includes:

(i) a contacting region of the outer face which is in contact with a surrounding area of the internal second surface of the lid that surrounds the at least one outlet hole, and (ii) a non-contacting region of the outer face thereof which is not in contact with the internal second surface of the lid but which covers the at least one outlet hole thereof, wherein the non-contacting region of the at least one burstable membrane establishes a bursting zone of the at least one burstable membrane thereby allowing only the non-contacting region of the burstable membrane which covers the at least one outlet hole to burst at the at least one outlet hole when the pressurized liquid is introduced into the hollow element through the top face of the hollow element while the contacting region of the at least one burstable membrane surrounding the at least one outlet hole remains in contact with the internal second surface of the lid to thereby allow coffee to be discharged through the bottom face of the hollow element only at the bursting zone of the at least one burstable membrane.

2. The capsule as claimed in claim 1, wherein the at least one burstable membrane is formed of a biodegradable flexible film.

3. The capsule as claimed in claim 1, which further comprises a filtering element formed of a filtering material selected from the group consisting of knitted fabrics, woven fabrics and filter paper is placed adjacent to an inner face of the at least one burstable membrane.

4. The capsule as claimed in claim 3, wherein the filtering element is placed between the dose of coffee in the hollow element and the inner face of the at least one burstable membrane.

5. The capsule as claimed in claim 4, wherein the at least one burstable membrane and the filtering element are in contact with one another along the entire inner surface of the at least one burstable membrane.

6. The capsule as claimed in claim 1, wherein the filtering element is formed of threads of biodegradable material.

7. The capsule as claimed in claim 1, wherein the at least one outlet hole has a cross section in the form of an ellipse.

8. The capsule as claimed in claim 1, wherein the at least one outlet hole has a cross section in the form of a polygon.

9. The capsule as claimed in claim 8, wherein the polygon is convex.

10. The capsule as claimed in claim 8, wherein the polygon is concave.

11. The capsule as claimed in claim 1, wherein the lid comprises several holes.

12. The capsule as claimed in claim 1, wherein the dose of coffee is a dose of ground coffee.

13. The capsule as claimed in claim 6, wherein the biodegradable material is selected from the group consisting of cotton, silk and other biodegradable material.

14. The capsule as claimed in claim 1, wherein the capsule comprises a sheet having an annular shape which is positioned on the external first surface of the lid.

15. The capsule as claimed in claim 14, wherein the sheet is made of paper or cardboard.

16. A capsule for the preparation of a coffee drink, wherein the capsule comprises:

a hollow element designed to contain a dose of ground coffee, the hollow element comprising a side wall, a top face and a bottom face having a surface greater than the top face, at least one burstable membrane having an outer face, wherein the at least one burstable membrane is non-apertured prior to use of the capsule and bursts under pressure of a pressurized liquid introduced into the hollow element in order to allow the pressurized liquid to flow through the dose of ground coffee, and a lid which has a first face forming an external first surface of the capsule and a second face forming an internal second surface of the capsule, wherein the lid defines at least one outlet hole having a non-circular shape which extends between the internal second surface and the external first surface thereof for discharging the drink prepared in the hollow element, wherein the at least one burstable membrane includes:

(i) a contacting region of the outer face which is in contact with a surrounding area of the internal second surface of the lid that surrounds the at least one outlet hole, and (ii) a non-contacting region of the outer face which is not in contact with the internal second surface of the lid but which covers the at least one outlet hole thereof, wherein the non-contacting region of the at least one burstable membrane establishes a bursting zone of the at least one burstable membrane thereby allowing only the non-contacting region of the at least one burstable membrane which covers the at least one outlet hole to burst at the at least one outlet hole when the pressurized liquid is introduced into the hollow element through the top face of the hollow element while the contacting portion of the at least one burstable membrane surrounding the at least one outlet hole remains in contact with the internal second surface of the lid to thereby allow coffee to be discharged through the bottom face of the hollow element only at the bursting zone of the at least one burstable membrane.

17. The capsule as claimed in claim 16, wherein the at least one burstable membrane is formed of a biodegradable flexible film.

18. The capsule as claimed in claim 16, which further comprises a filtering element formed of a filtering material selected from the group consisting of knitted fabrics, woven fabrics and filter paper is placed adjacent to an inner face of the at least one burstable membrane.

19. The capsule as claimed in claim 18, wherein the filtering element is placed between the dose of coffee in the hollow element and the inner face of the at least one burstable membrane.

20. The capsule as claimed in claim 19, wherein the at least one burstable membrane and the filtering element are in contact with one another along the entire inner surface of the at least one burstable membrane.

21. The capsule as claimed in claim 16, wherein the filtering element is formed of threads of biodegradable material.

22. The capsule as claimed in claim 16, wherein the at least one outlet hole has a cross section in the form of an ellipse.

23. The capsule as claimed in claim 16, wherein the at least one outlet hole has a cross section in the form of a polygon.

24. The capsule as claimed in claim 23, wherein the polygon is convex.

25. The capsule as claimed in claim 23, wherein the polygon is concave.

26. The capsule as claimed in claim 16, wherein the lid comprises several holes.

27. The capsule as claimed in claim 16, wherein the dose of coffee is a dose of ground coffee.

28. The capsule as claimed in claim 16, wherein the biodegradable material is selected from the group consisting of cotton, silk and other biodegradable material.

29. The capsule as claimed in claim 16, wherein the capsule comprises a sheet having an annular shape which is positioned on the external first surface of the lid.

30. The capsule as claimed in claim 29, wherein the sheet is made of paper or cardboard.

31. The capsule according to claim 1 or 16, wherein the side wall of the hollow element surrounds the lid.

32. The capsule according to claim 1 or 16, wherein the bottom face of the hollow element comprises a plurality of layers, and wherein each of the lid and the at least one burstable membrane form a respective layer of the plurality of layers.

* * * * *